United States Patent [19]

Miyake et al.

[11] Patent Number: 4,872,035

[45] Date of Patent: Oct. 3, 1989

[54] IMAGE FORMING APPARATUS

[75] Inventors: Hiroyuki Miyake, Inagi; Seiji Sagara, Yokohama; Takaji Yonemori, Tokyo; Tsuyoshi Watanabe, Yokohama; Masayoshi Takahashi, Chofu; Koji Suzuki, Yokohama; Yutaka Komiya, Tokyo; Masahiro Tomosada; Hideki Adachi, both of Kawasaki; Masayuki Hirose, Yokohama; Masanori Miyata, Mitaka, all of Japan

[73] Assignee: Canon Kabushiki Kaisha, Tokyo, Japan

[21] Appl. No.: 153,577

[22] Filed: Feb. 2, 1988

Related U.S. Application Data

[63] Continuation of Ser. No. 808,215, Dec. 11, 1985, abandoned, Continuation of Ser. No. 497,175, May 23, 1983, abandoned.

[30] Foreign Application Priority Data

May 31, 1982 [JP] Japan ..... 57-92505

[51] Int. Cl.[4] ..... G03G 15/00

[52] U.S. Cl. ..... 355/208; 355/219; 355/222; 355/228; 355/243

[58] Field of Search ..... 355/14 CH, 14 E, 14 R, 355/14 C, 3 SH, 55, 56, 57

[56] References Cited

U.S. PATENT DOCUMENTS

| | | | |
|---|---|---|---|
| 3,053,962 | 9/1962 | Cerasani et al. | 219/388 |
| 3,606,534 | 9/1971 | Alman et al. | 355/8 |
| 4,019,102 | 4/1977 | Wallot | 355/14 CH |
| 4,335,953 | 6/1982 | Tsuchiya et al. | 355/14 CH |
| 4,358,520 | 11/1982 | Hirayama | 430/54 |
| 4,411,514 | 10/1983 | Komori et al. | 355/14 CH |

FOREIGN PATENT DOCUMENTS 3015820A 11/1980 Fed. Rep. of Germany .

*Primary Examiner*—A. C. Prescott

*Attorney, Agent, or Firm*—Fitzpatrick, Cella, Harper & Scinto

[57] ABSTRACT

There is disclosed an image forming apparatus capable of controlling the image forming conditions in different modes according to the magnification of the image to be formed, or according to the process speed.

36 Claims, 13 Drawing Sheets

FIG. 11

| ZONE | TARGET OF SURFACE POTENTIAL | INITIAL VALUE OF REF. CURRENT & LIGHT VOLTAGE | CONTENT OF REFRESH MEMORY | CORRECTION IN AUTO-EXPOSURE |
|---|---|---|---|---|
| POTENTIAL CONTROL ZONE A | $V_{D0}$ | $I_{P1}^{(A,B)}$ $v_{H1}^{(A,B)}$ (ZONES A&B COMMON) | $I_{Pn}^{(A)}$ $v_{Hn}^{(A)}$ (ONLY ZONE A) | $v_{H \cdot AE}$ (EXPOSURE CONTROL ACCORDING TO EACH ORIGINAL) |
| POTENTIAL CONTROL ZONE B | | | $I_{Pn}^{(B)}$ $v_{Hn}^{(B)}$ (ONLY ZONE B) | $v_{H \cdot AE}$ |
| POTENTIAL CONTROL ZONE C | $V_{L0}$ | $I_{P1}^{(C,D)}$ $v_{H1}^{(C,D)}$ (ZONES C&D COMMON) | $I_{Pn}^{(C)}$ $v_{Hn}^{(C)}$ (ONLY ZONE C) | $v_{H \cdot AE}$ |
| POTENTIAL CONTROL ZONE D | (ALL ZONES COMMON) | | $I_{Pn}^{(D)}$ $v_{Hn}^{(D)}$ (ONLY ZONE D) | $v_{H \cdot AE}$ |

IMAGE FORMING APPARATUS

This application is a continaution of application Ser. No. 808,215 filed Dec. 11, 1985, now abandoned, which is a continuation of original application Ser. No. 497,175 filed May 23, 1983, now abandoned.

BACKGROUND OF THE INVENTION

1. Field of the Invention

The present invention relates to an image forming apparatus for effecting image formation on a recording member, such as a copier.

2. Description of the Prior Art

There are already known copiers with variable image magnification for enlarging or reducing the original image. In such copiers the distribution of the light intensity on the photosensitive drum has to be uniform both in the one-to-one copying mode and in the copying mode with modified image magnification, and such uniform light distribution has been conventionally achieved by the use of a light distribution correcting plate, such as a slit, positioned in the vicinity of the photosensitive drum. An example of such correction for light distribution in the actual size copying, reduction copying and enlarged copying is shown in FIGS. 1A, 2B and 1C. The original illuminating system is so constructed as to compensate the so-called $\cos^4\theta$ rule of a lens 50 in the real-size copying mode. Thus the illuminating system has a distribution of illumination intensity on the original document as represented by a curve 100 to obtain a uniform intensity distribution on the photosensitive drum as represented by 200 after passing the lens 50. However, in case the image magnification is modified, the distribution of the illumination intensity becomes uneven as represented by 201 or 202, respectively in case of size reduction or size enlargement, since the angle of viewing the original document from the lens changes in such cases. Such unevenness has been corrected as represented by 201' or 202' by the insertion of a slit 301 or 302, respectively in case of size reduction or size enlargement, of which forms are respectively shown in FIGS. 2A and 2B.

The use of such slits in the modified size copying mode enables to obtain a uniform light intensity distribution on the photosensitive drum, but at the same time results in a loss of light amounting even to about 30%, because of partial shielding of the light by said slit. Such loss of light is compensated by employing a lower process speed in such modified size copying mode than, for example equal to 0.7 times of, the process speed in the real-size copying mode, and the amount of light at such modified size copying mode is rendered adjustable, for example with a slit, to 0.7 times of that in the real-size copying mode. Also the use of such lower process speed in the modified size copying mode prevents the vibration of image which may be caused, in the reduction copying, by a high scanning speed (=process speed/image reduction rate).

Also there is already known a control process for chargers, developing device etc. in response to the detection of surface state, for example surface potential of the photosensitive member in order to achieve stable image reproduction. FIG. 3 shows an example of such control process, wherein a three-layered photosensitive drum 500, having an insulating layer, a photoconductive layer and a conductive layer in this order from the external periphery, is surrounded, in the order same as the direction of rotation thereof, by a primary charger 501 for uniformly charging said drum, a secondary charger 502 for charge elimination and a whole-surface exposure lamp 503. An original document placed on a carriage is illuminated by a light source 504 such as a halogen lamp, and the reflected light is focused through a lens 506 onto the photosensitive drum 500 at a position the charge on said drum according to the amount of exposure to the original image, thereby forming an electrostatic latent image on the drum corresponding to the original image. The electrostatic latent image thus formed is entirely exposed to the light from the whole-surface exposure lamp 503 to obtain a latent image with improved gradation. Thereafter the latent image moves to a developing device and is developed with toner by a developing roller 514 to which a bias voltage is supplied. A blank exposure lamp 507 constantly illuminates the photosensitive drum when the original exposure lamp 504 is not lighted while the chargers are in operation, in order to prevent the toner deposition in the non-image area. In the vicinity of the photosensitive drum 500 and between the developing device and the whole surface exposure lamp 503, there is provided a surface potential sensor 505 for measuring the surface potential of the drum. The output signal of said sensor is amplified and converted into digital signals in a surface potential measuring circuit 508, and is then supplied to a potential control circuit 513 composed for example of a microcomputer for effecting data processing according to the measured surface potential. The results of said processing are converted into analog signals and are supplied to high-voltage generating circuits 509, 510, a developing bias circuit 511 and an exposure control circuit 512 for respectively controlling the voltages supplied to the primary and secondary chargers, the developing bias voltage and the voltage to the halogen lamp. The control of the image forming conditions in the above-described apparatus is achieved in the following manner.

After the start of power supply, the drum is subjected to a pre-rotation step for stabilizing the performance of the photosensitive member. Then reference currents $I_{po}$, $I_{so}$ are respectively supplied to the primary and secondary chargers 501, 502, and the surface potential sensor 505 measures the dark potential $V_D$ after the entire illumination with the After the start of power supply, the drum is subjected to a pre-rotation step for stabilizing the performance of the photosensitive member. Then reference currents $I_{po}$, $I_{so}$ are respectively supplied to the primary and secondary chargers 501, 502, and the surface potential sensor 505 measures the dark potential $V_D$ after the entire illumination with the whole surface exposure lamp 503, and the light potential $V_{SL}$ after the illumination with the blank exposure lamp 507 at the highest intensity. Then the primary and secondary currents $I_p$, $I_s$ are corrected so as to bring the light and dark potentials $V_{SL}$, $V_D$ closer to the target values, and such correcting cycle is repeated for example four times.

Then the original exposure lamp 504 is lighted with a reference voltage $V_{HO}$, and the surface potential sensor 505 measures the potential $V_L$ of the latent image formed on the photosensitive drum corresponding to a standard white plate. Then the lamp voltage $V_H$ is corrected so as to bring said potential $V_L$ closer to zero, and this cycle is repeated for example three times. The developing bias voltage is obtained by adding a determined voltage to said potential $V_L$. The above-described control allows to bring the photosensitive characteristic, for example represented by a full-lined curve in FIG. 4, to an ideal characteristic represented by a broken-lined curve. The succeeding copying cycle is conducted with thus corrected primary and secondary charging currents $I_p$, $I_s$ and lighting voltage $V_H$.

Such control is conducted, also in the modified size copying mode, with the optical path and the process speed for the real-size copying mode to determine $I_p$, $I_s$ and $V_H$ in the aforementioned manner, and the primary and secondary charging currents in the modified size copying mode are obtained by multiplying for example 0.7 with said values $I_p$, $I_s$ if the process speed in the modified size copying mode is 0.7 times of that in the real-size copying mode.

Such control process however requires a long time and involves the complexity of maintaining required mechanical precision, since, in the modified size copying mode, the optical system is at first returned to the position for the real-size copying mode and is then brought to the position for the modified size copying mode after the potential control in the aforementioned manner.

Also in such process, the image density and the gradation of intermediate image tone in the modified size copying mode become different from those in the real-size copying mode, since the reciprocity does not stand in strict sense.

In addition, the number of corrections for the charging currents and for the lighting voltage is determined in advance, so that the correcting operations have to be repeated wastefully even when the charging current or the lighting voltage is already at the target value or when the correction is no longer possible because of the limitation in the capacity of the power supply.

SUMMARY OF THE INVENTION

In consideration of the foregoing, an object of the present invention is to provide an image forming apparatus capable of constantly providing images with satisfactory image quality.

Another object of the present invention is to provide an image forming apparatus capable of controlling the image forming conditions in different modes according to the image magnification.

Still another object of the present invention is to provide an image forming apparatus capable of controlling the image forming conditions in different modes according to the process speed.

The foregoing and still other objects of the present invention will become apparent from the following description.

BRIEF DESCRIPTION OF THE DRAWINGS

FIG. 5-2 is a perspective view of a light amount correcting plate and a $\cos^4\theta$ rule correcting plate embodying the present invention;

FIG. 5-3 is a plane view of a control panel;

FIG. 11 is a chart showing the data obtainable in said control zones;

FIGS. 14-1 and 14-2 are timing charts in embodiments of the present invention.

DETAILED DESCRIPTION OF THE PREFERRED EMBODIMENTS

Now the present invention will be clarified in detail by embodiments thereof shown in the attached drawings.

Figures 1, 5:
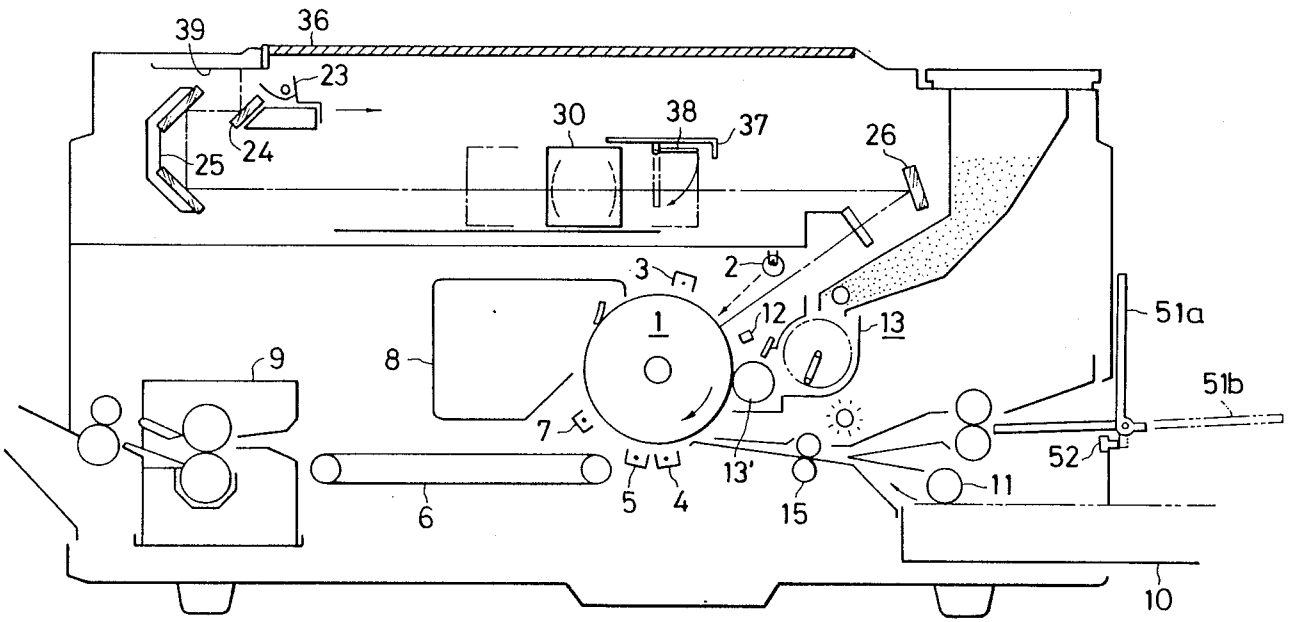
FIG. 5-1 is a cross-sectional view of a copier in which the present invention is applicable.

FIG. 5-1 is a cross-sectional view of a copier embodying the present invention, of which structure and function will be explained in the following.

A photosensitive drum 1 is rotated in a direction indicated by the arrow by means of an unrepresented motor. An original document placed on an original carriage glass 36 is illuminated by a lamp 23 constructed integrally with a first scanning mirror 24, and the reflected light is scanned by said first scanning mirror 24 and a second scanning mirror 25, which are displaced with a speed ratio of 1:½ to maintain a constant optical path length in front of a lens 30.

Said reflected light is focused on said drum 1 in an exposure station, through a zoom lens 30 and a third mirror 26.

The drum 1 is in advance uniformly charged, either positively or negatively, by a primary charger 3, and an electrostatic latent image is formed on said drum by said reflected light. The electrostatic latent image formed on the drum 1 is developed as a visible toner image by a developing roller 13' in a developing station, and said toner image is transferred onto a transfer sheet by means of a transfer charger 4. The transfer sheet contained in a cassette 10 is advanced by a feeding roller 11, and supplied toward the photosensitive drum 1 with an exact timing measured by a registering roller 15 in such a manner that the leading end of the latent image coincides with that of the transfer sheet at the transfer station. In said transfer station corona discharge is applied by the transfer charger 4 from the rear side of the transfer sheet, thereby electrostatically transferring the toner image onto said transfer sheet. Then, a separating charger 5, generating AC corona discharge or DC corona discharge of a polarity opposite to that of the transfer charger 4, neutralizes the charge on the rear face of the transfer sheet, whereby said transfer sheet is separated from the photosensitive drum 1 and is transported by a conveyor belt 6. After said separation of the transfer sheet, the photosensitive drum 1 is at first subjected to charge elimination by charge pre-eliminator 7, and the toner remaining on the photosensitive drum 1 is removed by a cleaner 8. On the other hand the transfer sheet passes through a fixing station 9 for permanently fixing the toner image thereon.

Figures 2, 5:
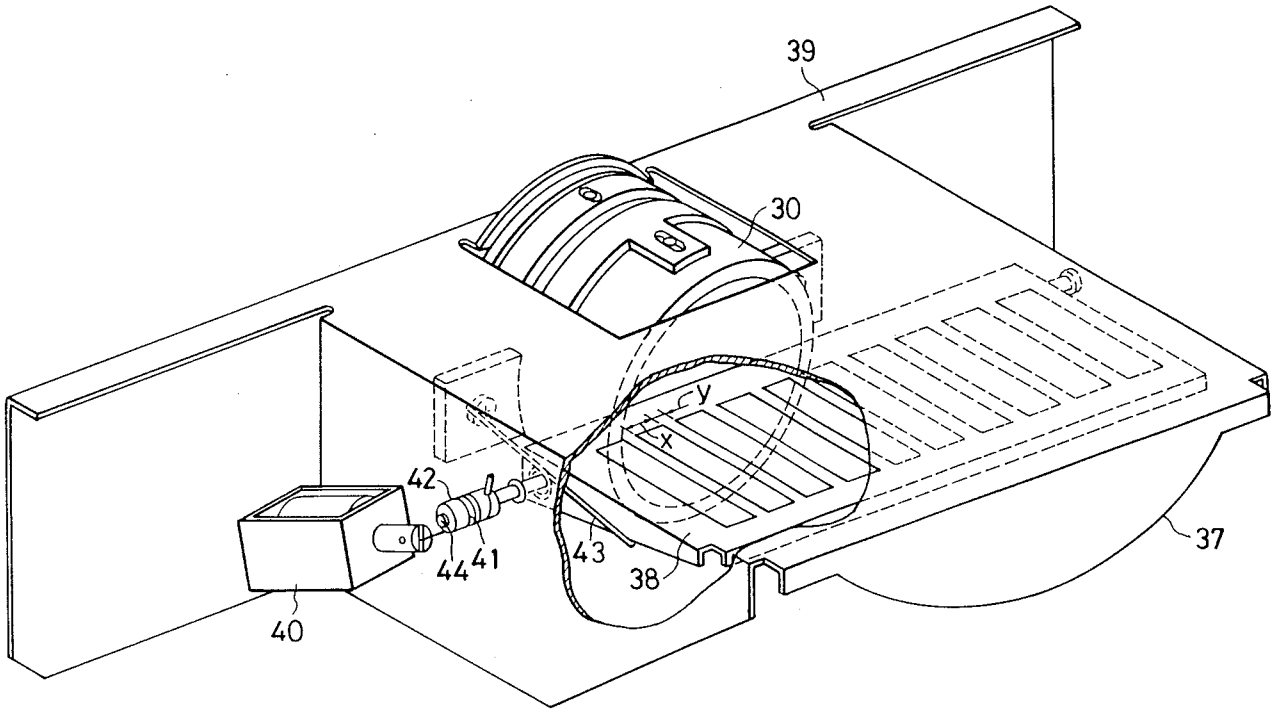
Figures 3, 5:
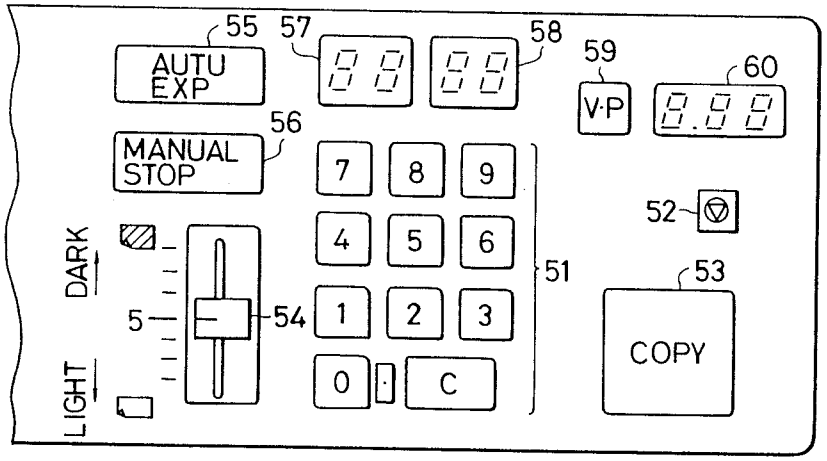

FIG. 5-2 is a perspective view of the zoom lens 30 and related mechanism, wherein same components as those in FIG. 5-1 are represented by same numbers. A hood member 39 mounted on the zoom lens 30 for avoiding dusts and unnecessary light is provided with a correcting plate 37 for correcting the amount of light in response to the $\cos^4\theta$ rule of the lens, thereby obtaining uniform illumination intensity on the photosensitive drum. A light amount correcting plate 38, for correcting the amount of light in case the process speed is changed for the modified size copying mode, is provided with vertical slots so as not to interfere with the function of the aforementioned $\cos^4\theta$ rule correcting plate 37, wherein the, width x of each slot and the distance y of neighboring slots are selected with a ratio of 7:3 to reduce the amount of light falling on the photosensitive drum to 70% when said light amount correcting plate 38 is inserted. A solenoid 40 for controlling said correcting plate 38 rotates, when energized, a shaft 44 through a wire 41 and a pulley 42, whereby the correcting plate 38 rotates clockwise by ca. 90° against the biasing force of a returning spring 43.

Figures 1A, 1B, 1C:
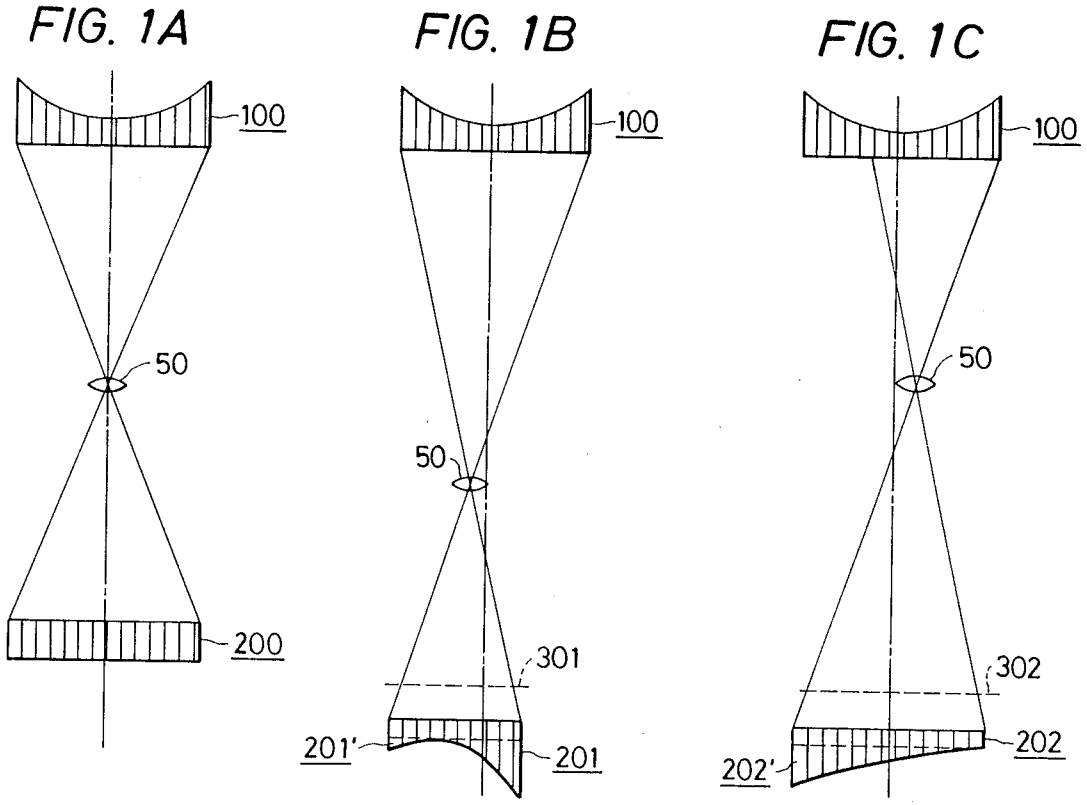
FIGS. 1A to 1C are views showing a conventional process for correcting the light distribution.
Figure 2A:
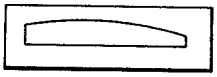
FIGS. 2A and 2B are views showing the forms of slits utilized therefor.
Figure 2B:
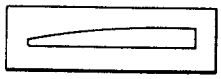
Figure 3:
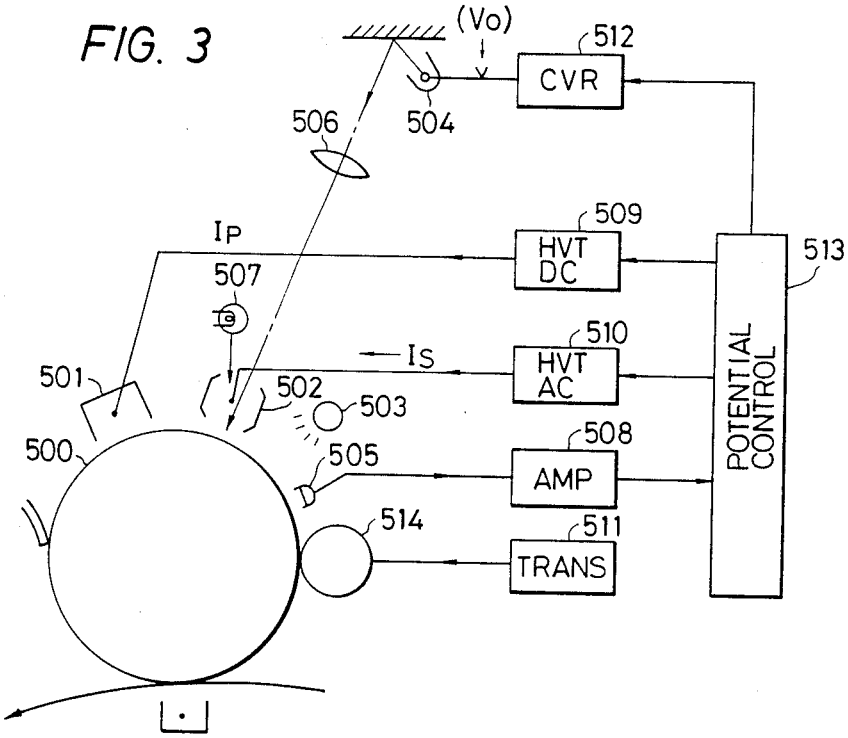
FIG. 3 is a schematic cross-sectional view of a copier.
Figure 4:
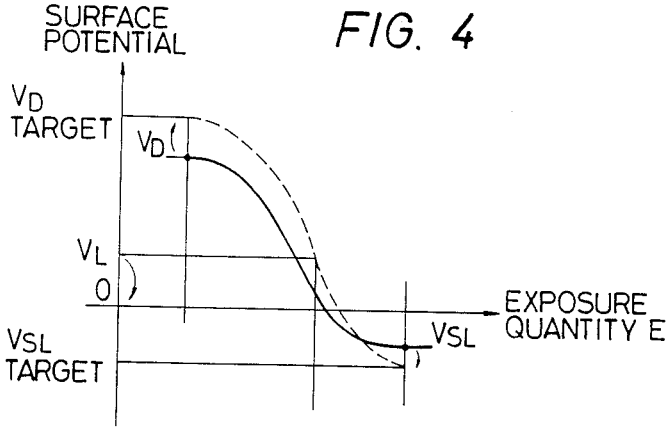
FIG. 4 is a chart showing the photosensitive characteristic of a photosensitive member.

FIG. 5-3 is a plan view showing a part of the control panel of the copier shown in FIG. 5-1. In said control panel there are provided numeral keys 51 for setting a desired copy number, up to 99 copies, on a display unit 57; a clear key C for clearing the display on said display unit 57; a stop key 52 for interrupting the operation of the copier at a stage where the copy count (number of prepared copies) does not reach the set copy number, wherein the actuation of said stop key terminates the operation of the copier as soon as a copying cycle already in execution is completed; a start key 53 for initiating the copying operation; 7-segment display units 57, 58 composed for example of light-emitting diodes or of liquid crystal display elements for respectively indicating the set copy number and the copy count; a lever 54 for selecting the image density; a key 55 for selecting an automatic exposure mode to be explained later; and a key 56 for enabling manual image density selection with said lever 54. The keys 55, 56 are internally provided with lamps which are lighted when said keys are actuated. The manual density selecting mode activated by the key 56 returns automatically to the automatic exposure mode if the copier is not manipulated in excess of 1 minute. There is also provided a modified size mode key 59 for selecting the modified size copying mode and for enabling the entry of a desired image magnification with the aforementioned numeral keys. Said image magnification can be entered in the order of a number above the decimal point, then the decimal point, and numbers below the decimal point, and thus entered magnification is displayed on a 3-digit 7-segment display unit 60.

Figure 6:
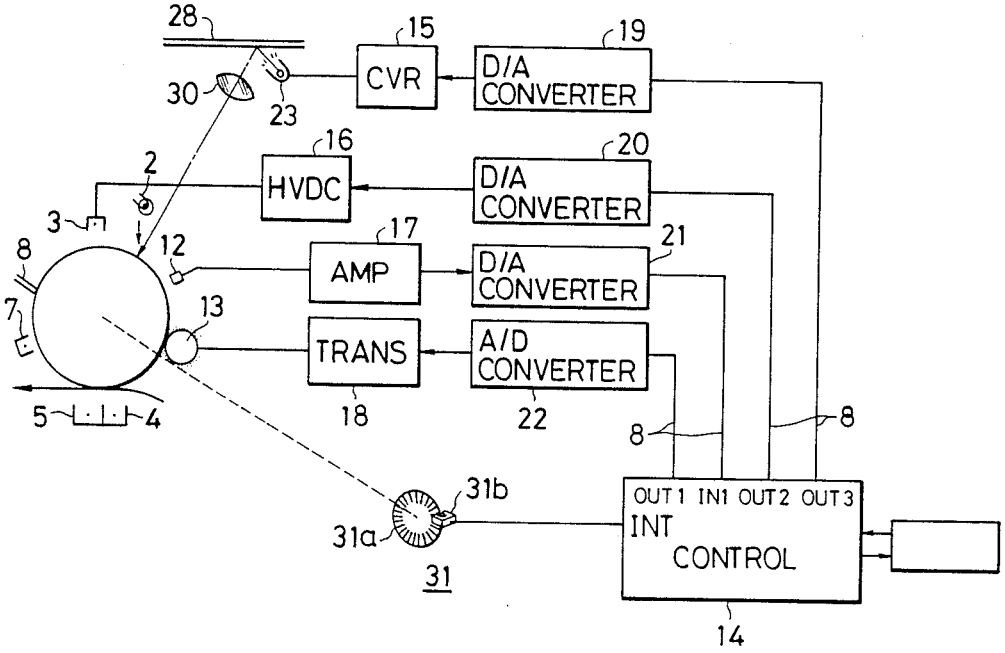
FIG. 6 is a block diagram showing the control system for use in the copier shown in FIG. 5-1.

FIG. 6 is a block diagram showing the control unit of the copier shown in FIG. 5, wherein same components as those in FIG. 5 are represented by same numbers. In FIG. 6 there are shown a control unit 14 composed of a known one-chip microcomputer incorporating read-only memory, random access memory etc.; an exposure control circuit 15 for lighting the illuminating lamp 23 and adapted to receive a control signal supplied from an output port OUT3 of the control unit 14 through a D/A converter 19; a high voltage generating circuit 16 for driving the primary charger 3 and adapted to receive a control signal supplied from an output port OUT2 of the control unit 14 through a D/A converter 20; an amplifier 17 for amplifying the output signal from the potential sensor 12 and supplying the amplified signal, after conversion into digital signal by an A/D converter 21, to an input port IN1 of the control unit 14; a developing bias transformer 18 for generating the bias voltage to be supplied to the developing roller 13 and adapted to receive a control signal supplied from an output port OUT1 of the control unit 14 through a D/A converter 22; a control-display device incorporating the control unit as shown in FIG. 5-3 and connected to the control unit 14; and a drum clock pulse generator 31 composed of a clock disk 31a rotated in synchronization with the photosensitive drum 1 and a photo-interrupter **31*b*, wherein said clock disk is provided with fine slits along the periphery thereof and said photo interrupter 31*b* senses said slits to generate clock pulses which are supplied to an interruption port of the control unit 14** for achieving various sequence controls.

In the following there will be given an explanation of the potential control employed in the copier of the present embodiment. In the pre-rotation step, the photosensitive drum 1 is rotated several turns to stabilize the performance of the photosensitive member while the blank exposure lamp 2 is continuously lighted and other conditions are maintained same as those in the normal copying operation. Then the control unit 14 supplies a signal through the D/A converter 20 to the high-voltage generating circuit (HVDC) 16 in order to supply a reference current $I_{po}$ to the primary charger 3. The potential sensor 12 detects the dark potential $V_D$ of the photosensitive drum 1 and supplies it to the control unit 14 through the amplifier 17 and the A/D converter 21. The control unit 14 compares the surface potential $V_D$ detected by the potential sensor 12 with a target dark potential $V_{DO}$ and accordingly controls he high-voltage generating circuit 16 for regulating the current $I_p$.

In the present embodiment the target value is selected as 400±20 V, and the detection of the surface potential $V_D$ and the control of the high-voltage generating circuit 16 are repeated four times at maximum in case the surface potential $V_D$ does not fall within the above-mentioned target range.

However, the succeeding operation is initiated even if the surface potential $V_D$ does not fall within the target range after the fourth control of the high-voltage generating circuit 16. Also the surface potential $V_{SL}$ is not controlled since it is equal to zero when the blank exposure lamp 2 is lighted.

Then the control unit 14 releases a control signal through the exposure control circuit (CVR) 15 and the D/A converter 19 to light the illuminating lamp 23 with a standard intensity corresponding to a position "5" of the lever 54, whereby the lamp 23 illuminates the standard white plate 39 to project a corresponding image onto the photosensitive drum 1. The potential sensor 12 detects the corresponding potential $V_L$ and supplies it through the amplifier 17 and the A/D converter 21 to the control unit 14. The control unit 14 compares the surface potential $V_L$ detected by the potential sensor 12 with a target value $V_{LO}$ and accordingly control the exposure control circuit 15 to regulate the illuminating lamp 23.

In the present embodiment the target value $V_{LO}$ is selected as 100±15 V, and the detection of the surface potential $V_L$ and the control of the exposure control circuit 15 are repeated three times at maximum in case the surface potential $V_L$ does not fall within the above-mentioned target range.

However the succeeding operation is initiated even when the surface potential $V_L$ does not fall within the target range after the third control of the exposure control circuit 15.

After the completion of copying operations for the set copy number, a post-rotation step is conducted to electrostatically clean the photosensitive drum 1.

Figure 7:
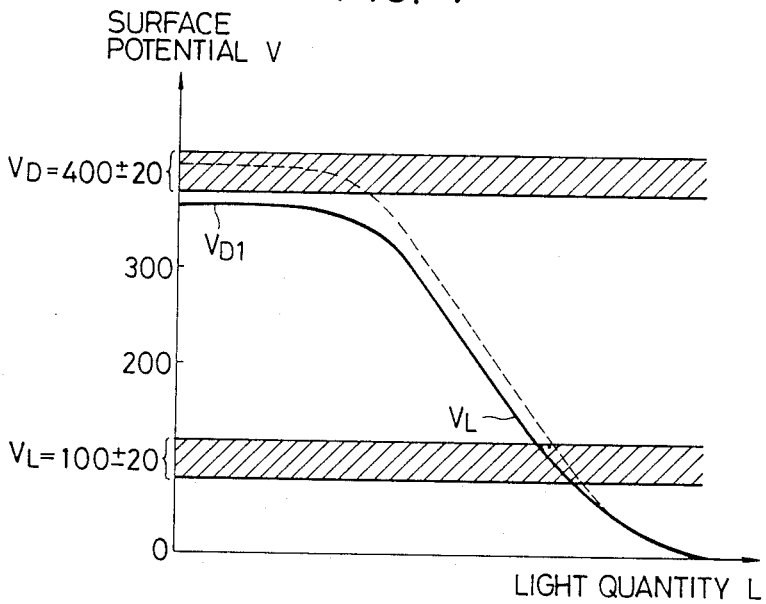
FIG. 7 is a chart showing the characteristic of a photosensitive member.

The above-described control of the dark potential $V_D$ and the light potential $V_L$ corresponding to the light reflected by the standard white plate 39 allows modification of the photosensitive characteristic, as represented by a solid-lined curve in FIG. 7, close to an ideal characteristic represented by a broken-lined curve.

The developing bias voltage for the developing roller 13 is determined by adding a determined voltage to the final light potential $V_L$ at the exposure control, and is supplied through the D/A converter 22 and the developing bias transformer 18.

Now there will be given an explanation on the automatic exposure mode. The copier of the present embodiment is capable of effecting a preliminary scanning on the original document to detect the density of the original document from the surface potential, and accordingly controlling the amount of light from the original exposure lamp thereby reproducing a white background even from an original with a colored background. The above-described mode is selected except when the key 56 is actuated. The reciprocating motion of the optical system for scanning the original document is effected by suitably energizing unrepresented forward and backward clutches. Now reference is made to FIGS. 6, 8 and 9 for further explanation.

In the present embodiment, an area corresponding to the minimum copiable size, for example B5-size, determined in the copier is scanned in the aforementioned manner under a determined illumination intensity of the illuminating lamp 23, and the corresponding surface potential on the photosensitive drum 1 is detected by the potential sensor 12.

The control unit 14 controls the exposure control circuit 15 to regulate the lighting voltage of the illuminating lamp 23, in response to the average value, or the minimum value of the surface potential detected in the preliminary scanning.

Figure 8:
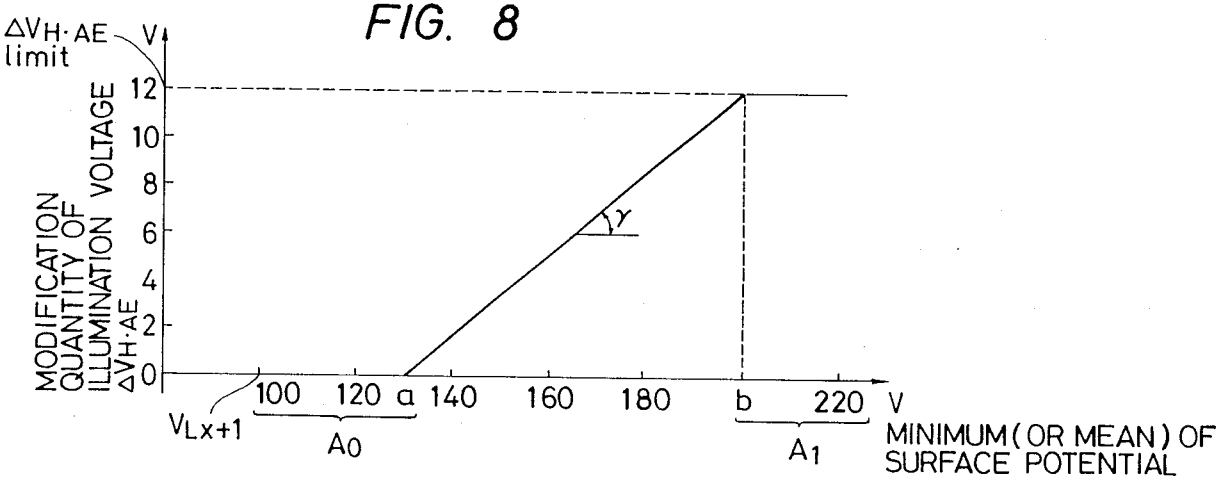
FIG. 8 is a chart showing a correction curve for the lighting voltage in the automatic exposure mode.

FIG. 8 shows the relationship, in the automatic exposure control mode, between the amount of regulation $\Delta V_{H \cdot AE}$ of the lighting voltage of the illuminating lamp 23 and the mean (or minimum) value of the surface potential V detected in the preliminary scanning.

The correction curve shown in FIG. 8 is stored in the control unit 14, and the regulation of the lighting voltage of the illuminating lamp 23 along said correction curve in response to the minimum (or mean) value of the detected surface potential enables to obtain a copy with white background from an original with colored background or from a newspaper.

In FIG. 8, an area A0, for example ranging from 100 V to 130 V, is called automatic exposure insensitive area. Such area is provided in order to avoid defective image reproduction which may arise if the lighting voltage for the illuminating lamp 23 is elevated directly proportional to the surface potential, since a potential sensor 12 of insufficient resolving power may detect an original containing small characters on white background or a blueprint of low density as gray.

Also an area A1, in excess of 200 V, is called an automatic exposure saturation area. In general the background of original documents is not black but may be colored to the extent of newspaper, roughly corresponding to a surface potential of 200 V. Therefore, a surface potential eventually detected as 300 V or 400 V would simply indicate that the potential sensor 12 is eventually positioned at a solid black area. The above-mentioned saturation area is provided since satisfactory image reproduction cannot be expected if the lighting voltage of the illuminating lamp 23 is elevated in response to such high surface potential.

The copier of the present embodiment can copy up to A3 size, but the preliminary scanning is conducted only in the minimum copiable B5 size, because preliminary scanning in such limited area can provide enough information on the original document and because preliminary scanning, if conducted in an area corresponding to the entire original size, will unnecessarily delay the first copying operation. However it is possible also to conduct said preliminary scanning in an area corresponding to the original size.

The developing bias voltage in the automatic exposure mode may be determined by adding a determined voltage to the final light potential $V_L$ at the exposure control in the aforementioned manner, or by adding a determined voltage to the minimum (or mean) value of the surface potential determined in said preliminary scanning.

Figure 9:
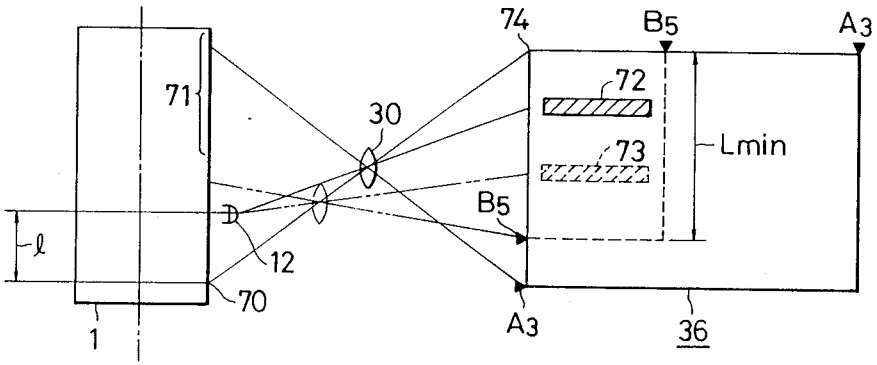
FIG. 9 is a view showing the position of the potential sensor.

The position of the potential sensor 12 is, as shown in FIG. 9, not at the center of the photosensitive drum 1 but is displaced slightly to a reference end of the image in order that said sensor is always positioned in the image area even in the modified size copying mode.

In FIG. 9 there are shown a carriage glass capable of receiving and exposing for copying an original document of up to A3 size; an area 71 which may not be exposed to the original image according to the image magnification; an area 72 for detection by the potential sensor 12 on the original in case of the real-size copying mode; an area 73 for detection by the potential sensor 12 on the original in case of the reduction copying mode; and a reference end 74 of the original. In such structure the distance l from the reference end 70 of the image to the potential sensor 12 can be represented as follows:

$$0 < l < \gamma_{min} \times L_{min}$$

wherein $\gamma_{min}$ is the minimum image magnification, and $L_{min}$ is the minimum dimension of the original. In FIG. 9 there is provided only one potential sensor 12, but it is also possible to provide plural sensors in the above-mentioned area.

FIG. 10 represents the image control process of the present invention, wherein the potential control zones are made different according to the image magnification and the process speed.

Since the reciprocity rule does not stand in strict sense in the modified size copying mode as explained before, the zones for potential control are made different according to the image magnification and the process speed. In the present embodiment the illumination intensity is made uniform and constant regardless of the image magnification by the correction already explained in relation to FIG. 5-2.

Also the process speed need not be changed for ordinary copying operations since the mechanical designing can sufficiently cope with the increased scanning speed at the reduction copying mode. The copier of the present embodiment is however provided with a manual feed tray 51*a*, as shown in FIG. 5-1, for copying on a manually fed sheet, said manual feed mode being activated by a selector switch 52 to be actuated by said manual feed tray 51*a* when it is moved to a position 51*b*.

In the copier of the present embodiment, therefore, a lower process speed is employed in such manual feed mode in order to interrupt the operation in time in case of erroneous feeding of the manually inserted sheet and to achieve sufficient image fixing in the fixing station 9 even on a thick sheet manually inserted.

Figure 10A:
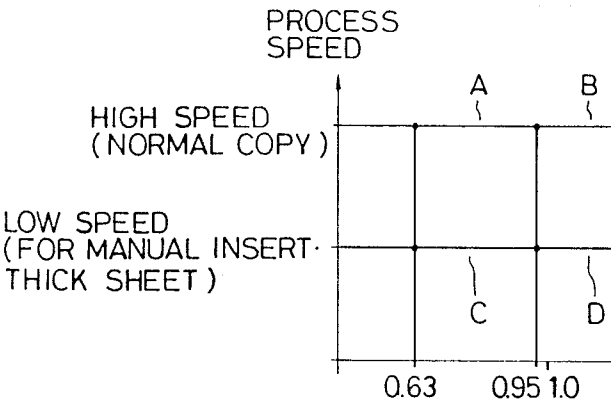
FIGS. 10A to 10D are views showing various control zones for use in the present invention.

FIG. 10A shows an embodiment of the present invention utilizing four different potential control zones A, B, C, D according to the image magnification and the process speed. The zone A is used for the high process speed for normal copying operation with the image magnification within a range from 0.63 to 0.95. The zone B is used for the high process speed for normal copying operation with the image magnification within a range from 0.95 to 1.41. The zone C is used for the low process speed for manually inserted or thick sheets with the image magnification in a range from 0.63 to 0.95. The zone D is used for the low process speed for manually inserted or thick sheet with the image magnification in a range from 0.95 to 1.41.

Figure 10B:
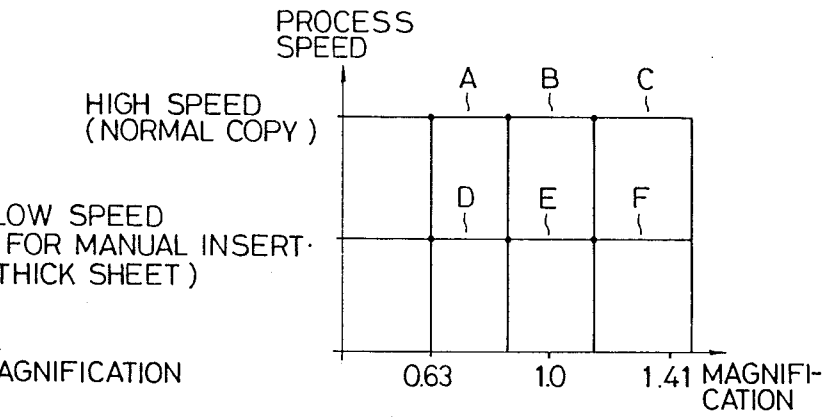
Figure 10C:
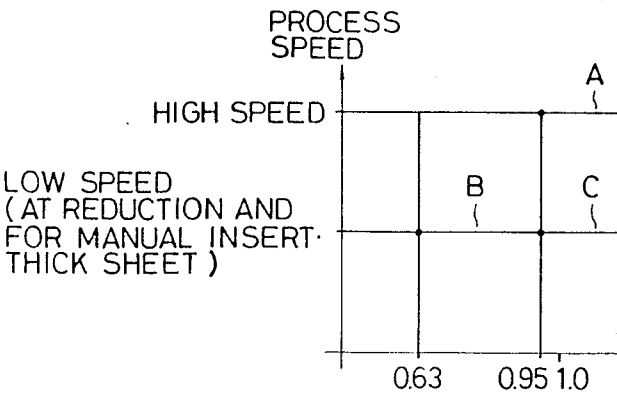

There may also be employed six potential control zones A–G, as shown in FIG. 10B, according to the extent of the reciprocity failure FIG. 10C shows another embodiment in which the low process speed, the same as that for the manually inserted or thick sheet is also employed in the reduction copying mode with image magnification in a range from 0.63 to 0.95.

Figure 10D:
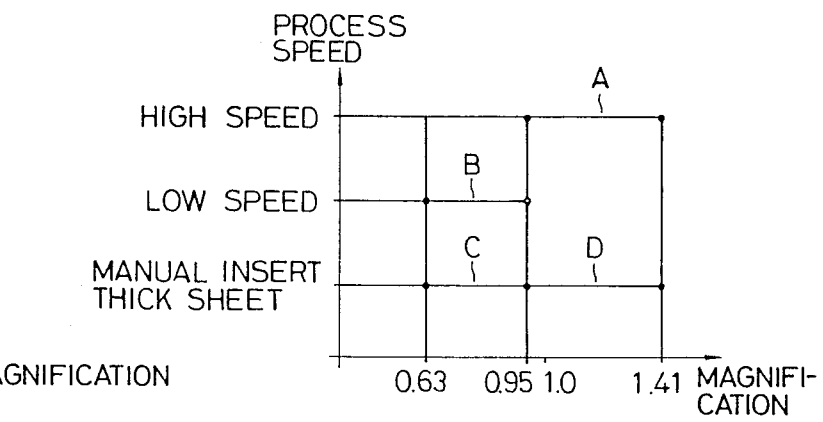

FIG. 10D shows still another embodiment in which the process speed for the manually inserted or thick sheets is selected different from the low process speed for normal reduction copying mode. In such case the potential control zones B and C may be used in common.

In any case the potential control zones may be divided according to the characteristic of latent image formation of the photosensitive member, or, the extent of reciprocity failure.

FIG. 11 shows the target values of the light and dark potentials, the initial values of the reference current to the charger 3 and of the reference lighting voltage of the illuminating lamp 23, the reference current and the reference lighting voltage of the illuminating lamp 23 corrected in the preceding cycle, and the reference lighting voltage of said lamp 23 in the automatic exposure control, in case the potential control zones are divided as shown in FIG. 10A. As will be understood from FIG. 10A, the target values $V_{DO}$ and $V_{LO}$ of the dark and light potentials are selected constant in all the potential control zones. On the other hand, the initial values $I_{pl}$ and $V_{Hl}$ of the reference current of the charger 3 and the lighting voltage of the illuminating lamp 23 at the first potential control are selected different between the zones A, B and the zones C, D. The control unit 14 shown in FIG. 6 is provided with a memory for storing the reference current $I_{pn}$ and the reference lighting voltage $V_{Hn}$ corrected in the preceding cycle for each zone, and such corrected values $I_{pn}$, $V_{Hn}$ are used as initial values in the succeeding cycle.

The surface potential control is conducted according to the following correction formulas:

(1) Correction of the reference current $I_p$ in response to dark potential:

$$I_{p2}=\alpha(V_D-V_{D1})+I_{p1}$$

$$I_{pn+1}=\alpha(V_D-V_{Dn})+I_{pn}$$

in which $I_{pn} \leqq I_{p\ limit}$, $n \leqq 4$ wherein:

$I_{pl}$: initial value of reference current $I_{pn}$: reference current after control of (n−1) times $V_D$: target value for dark potential $V_{D1}$: dark potential corresponding to reference current $I_{pl}$ $V_{Dn}$: dark potential corresponding to reference current $I_{pn}$, i.e. after control of (n−1) times $I_{p\ limit}$: limit of the power supply $\alpha$: correction coefficient (2) Correction of the lighting voltage $V_H$ in response to the light potential $$V_{H2}=\beta(V_L-V_{L1})+V_{H1}$$

$$V_{Hn+1}=\beta(V_L-V_{Ln})+V_{Hn} \text{ in which } V_{Hn} \leqq V_{H1\ limit}, n \leqq 4$$

wherein:

$V_{H1}$: initial value of reference lighting voltage for the illuminating lamp 23

$V_{Hn}$: reference lighting voltage after controls of (n−1) times $V_L$ target value for light potential $V_{L1}$: light potential corresponding to the initial value $V_{H1}$ of the reference lighting voltage $V_{Ln}$: light potential corresponding to the reference lighting voltage $V_{Hn}$, i.e. after controls of (n−1) times $V_{H1limit}$: limit of the lighting power source $\beta$: correction coefficient The reference lighting voltage $V_{H\cdot AE}$ of the illuminating lamp 23 in the automatic exposure mode is corrected for each zone in response to the reference current $I_{pn}$ and the reference lighting voltage $V_{Hn}$ corrected in the preceding cycle, according to the following correction formulas:

$$\Delta V_{H\cdot AE}=\begin{cases} 0 & \text{if } V_{L\cdot AE} \leqq a \text{ (insensitive area)} \\ \gamma\{V_{L\cdot AE}-(V_{Ln+1}+30)\} & \text{if } a < V_{L\cdot AE} \leqq b \\ \Delta V_{H\cdot AElimit} & \text{if } b \leqq V_{L\cdot AE} \text{ (saturation area)} \end{cases}$$

$$\gamma = \Delta V_{H\cdot AElimit}/b-a$$

wherein:

$\Delta V_{H\cdot AE}$ amount of correction of the reference lighting voltage of illuminating lamp 23 in automatic exposure control $V_{Ln+1}$: final light potential after controls of n times $V_{L\cdot AE}$: mean (or minimum) potential at the original exposure in the automatic exposure scanning $\gamma$: correction coefficient $\Delta V_{H\cdot AElimit}$: upper limit of amount of correction of the reference lighting voltage of the illuminating lamp 23 in the automatic exposure control.

Figures 12, 12A:
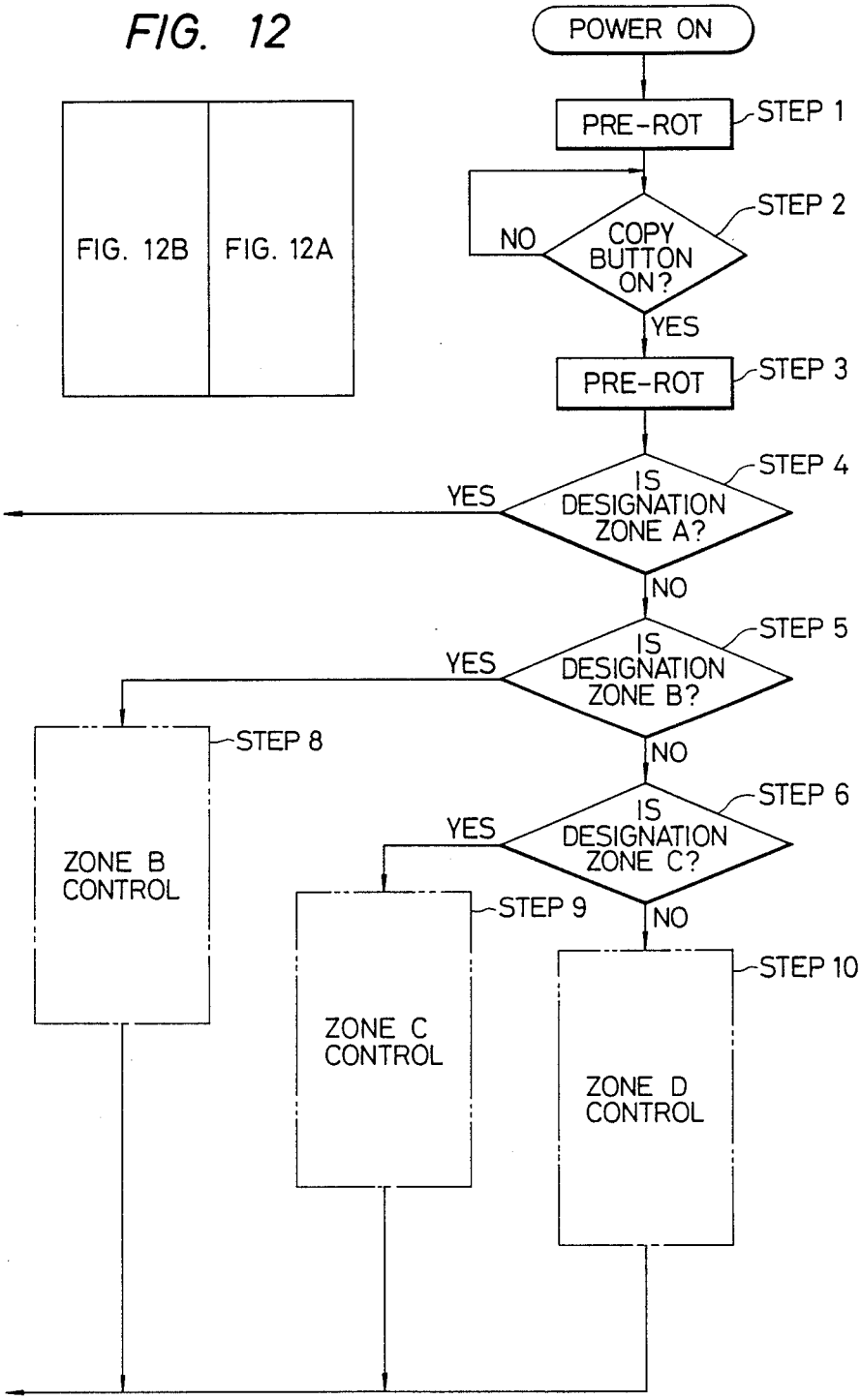
FIG. 12 composed of FIGS. 12A and 12B is a flow chart showing the sequential control in the present invention.
Figure 12B:
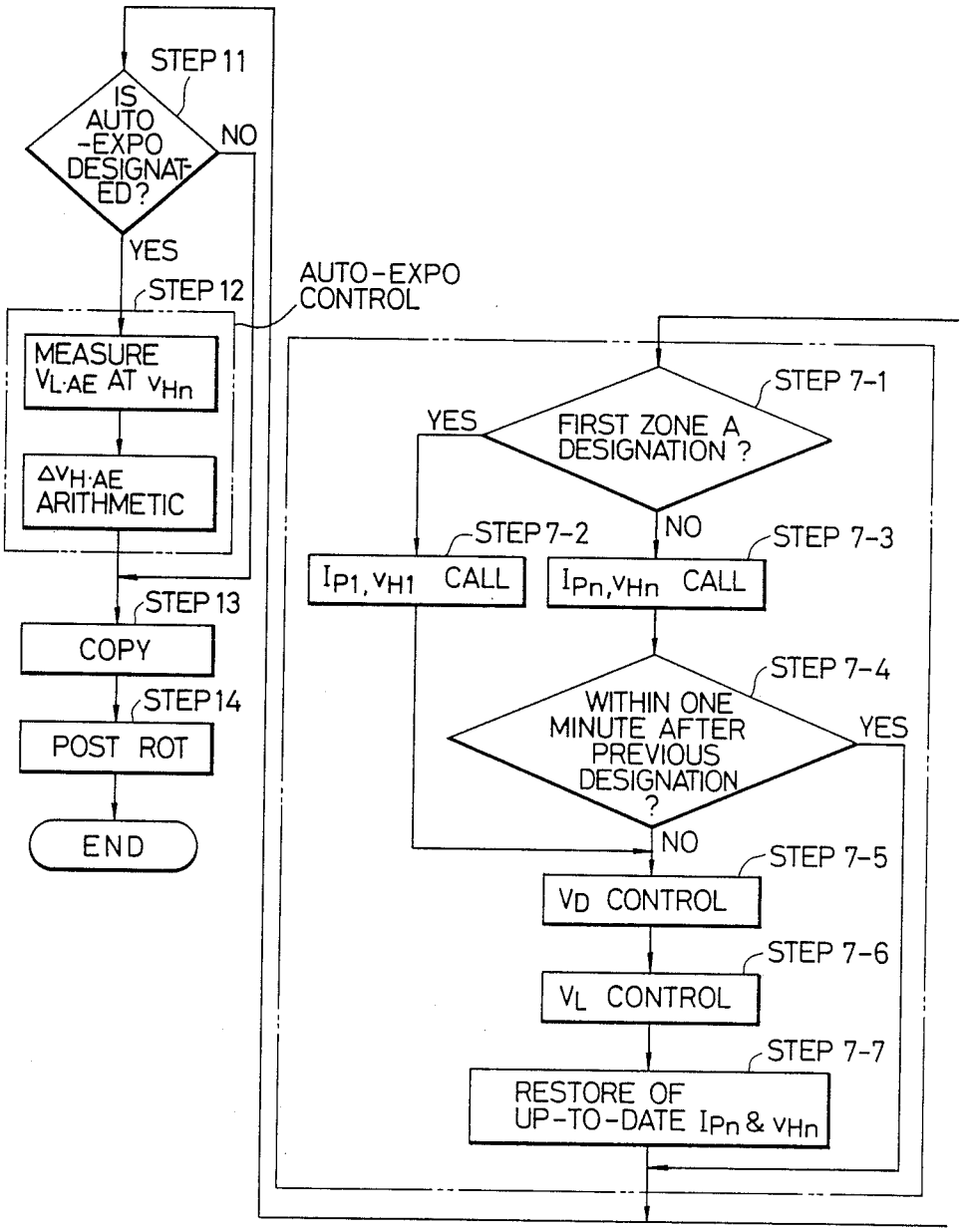

FIG. 12 is a flow chart showing the control flow of the present invention. After the start of power supply, a step 1 performs the pre-rotation step of the photosensitive drum for electrostatic cleaning of the drum surface. Then a step 2 discriminates whether the copy key has been actuated, and, if so, a step 3 executes the pre-rotation step in the same manner Then a step 4 and succeeding steps execute a control rotation step for obtaining a desired surface potential.

Steps 4 to 6 identify the zone A, B or C according to the entered image magnification and the process speed, and, if the zone A is selected, the program proceeds to a step 7 to effect the potential control corresponding to said control zone A shown in FIG. 11. Also the program proceeds to a step 8 or 9 if the zone B or C is respectively selected, or otherwise to a step 10, thereby effecting the potential control corresponding to the zone B, C or D.

In the following there will be explained, as an example, the potential control in the zone A. At first a step 7-1 identifies if the zone A is selected for the first time, and, if so, the program proceeds to a step 7-2 for reading, from the memory of the control unit 14, the reference current $I_{pl}^{(A,B)}$ for the charger 3 and the lighting voltage $V_{H1}^{(A,B)}$ of the illuminating lamp 23, which are common for the zones A and B. Then the program proceeds to a step 7-5. On the other hand, if the selection of the zone A is not for the first time, the final values $I_{pn}$, $V_{Hn}$ at the preceding control are read, from the memory of the control unit 14, as the initial values $I_{pl}$, $V_{H1}$ of the reference current of the charger 3 and of the lighting voltage for the illuminating lamp 23, and step 7-4 identifies whether the time from the previous selection of the zone A is within 1 minute. The program proceeds to a step 11 if said time is within 1 minute. If not, the program proceeds to steps 7-5, 7-6 for effecting the control to bring the dark potential $V_D$ to the target value $V_{DO}$ and to bring the light potential V to the target value $V_{LO}$, as will be shown in detail in FIG. 13

Now there will be explained the procedure of controlling the dark potential $V_D$. At first a step 7-5-1 discriminates whether the initial value $I_{pl}$ of the reference current is below the limit value $I_{p\,limit}$, and, if so, a step 7-5-2 is executed to detect, by the sensor 12, the dark potential $V_{Dn}$ generated on the photosensitive drum 1 when said reference current $I_{pl}$ is given to the charger 3 and to supply the detected potential to the control unit 14 after amplification in the amplifier 17 and digital conversion by the A/D converter 21. Then a step 7-5-3 discriminates whether said dark potential $V_{D1}$ is positioned within the target range, and, if not, a step 7-5-4 identifies whether the number of controls is within four, and, if so, a step 7-5-5 calculates $I_{p2}$ according to the aforementioned formula:

$$I_{pn+1}=\alpha(V_{DO}-V_{Dn})+I_{pn}.$$

Then the program returns to the step 7-5-1 to repeat the control with thus calculated value $I_{p2}$. The program proceeds to a step 7-6 after repeating the above-described control four times, or if the reference current $I_{pn}$ exceeds the upper limit $I_p$ limit in the step 7-5-1 or the dark potential $V_{Dn}$ falls within the target range in the step 7-5-3.

Figure 13:
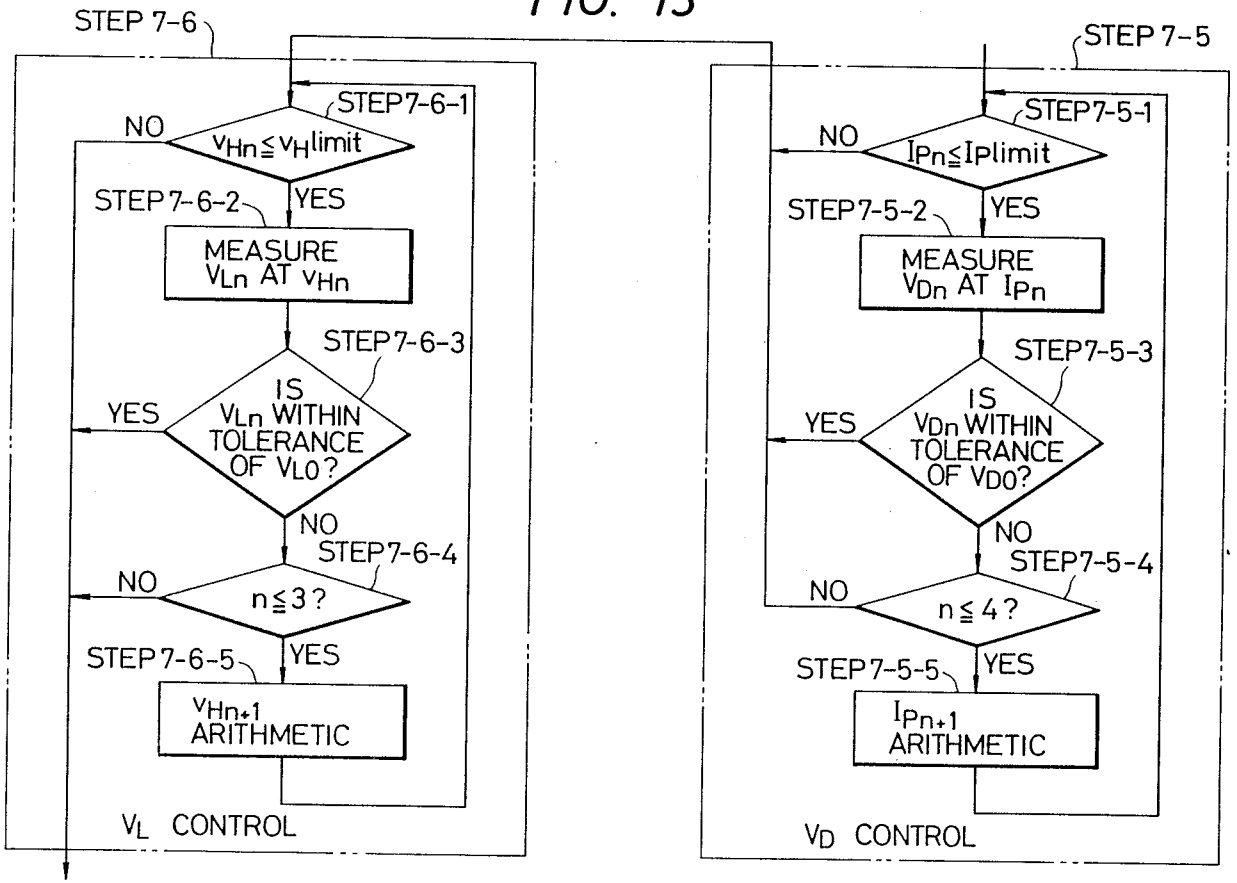
FIG. 13 is a flow chart showing the details of a part of the flow chart shown in FIG. 12.

After the completion of the control of dark potential $V_D$ in the step 7-5, the step 7-6 executes the control of the light potential $V_L$ as will be explained in the following in relation to FIG. 13. At first a step 7-6-1 compares the initial value $V_{H1}$ of the lighting voltage of the illuminating lamp with the upper limit $V_{H1limit}$, and, if said initial value is below said upper limit, a step 7-6-2 is executed to light the lamp 23 with said voltage $V_{H1}$ thereby forming the reflected image of the standard white plate 39 on the photosensitive drum 1, and to detect the surface potential $V_{L1}$ with the potential sensor 12. Then a step 7-6-3 discriminates whether thus detected potential is within the tolerance range of the target value $V_{LO}$ , and, if not, a step 7-6-4 identifies whether the number of controls is within three. As the number of controls is within three in this state, a step 7-6-5 is executed to calculate $V_{H2}$ according to the formula:

$$V_{Hn+1}=\beta(V_{LO}-V_{Ln})+V_{Hn}$$

and the program returns to the step 7-6-1 for repeating the same control. The program proceeds to a step 7—7 after repeating the above-described control three times, or if the lighting voltage $V_{Hn}$ exceeds the upper limit $V_{H1limit}$ in the step 7-6-1 or if the light potential falls within the target range in the step 7-6-3.

The step 7-7 stores the reference current $I_{pn}$ and the lighting voltage $V_{Hn}$, corrected in the steps 7-5 and 7-6, into the memory of the control unit 14.

In case the zone B, C or D is selected in the steps 4 to 6, a similar control is executed respectively in a step 8, 9 or 10 according to the control values corresponding to thus selected zone.

Then a step 11 discriminates whether the automatic exposure mode is selected, and, if not, the program proceeds to a step 13.

On the other hand, if the automatic exposure mode is selected, the program proceeds to a step 12 to light the illuminating lamp 23 with the lighting voltage $V_{Hn}$ corrected in the above-described control, to scan the original to be copied in an area of B5 size for forming a corresponding electrostatic latent image on the drum 1, and to detect the potential thereof by the potential sensor 12 for determining the mean value $V_{L\cdot AE}$ of said potential. Thus the amount of correction $V_{H\cdot AE}$ for the lighting voltage of the illuminating lamp is determined according to the correction formula:

$$\Delta V_{H\cdot AE}=\gamma\cdot\{V_{L\cdot AE}-(V_{Ln+1}+30)\}$$

and the lighting voltage of said lamp 23 is obtained by adding said correction $\Delta V_{H\cdot AE}$ to the voltage $V_{Hn}$. The above-described control may also be conducted with the minimum value of the potential of the latent image.

Then a step 13 lights the illuminating lamp 23 with the voltage thus corrected and effects the ordinary original scanning, thereby forming an electrostatic latent image corresponding to the original document on the photosensitive drum 1. Said latent image is then developed with a developing bias voltage obtained by adding a determined voltage to the mean (or minimum) value of the surface potential determined in the preliminary scanning in case of the automatic exposure mode, or otherwise with a developing bias voltage obtained by adding a determined voltage to the final light potential controlled in the step 7-6. After the completion of copying operations of the entered copy number, a step 14 effects a post-rotation step of the photosensitive drum 1 for electrostatically cleaning the photosensitive member.

Figures 1, 14:
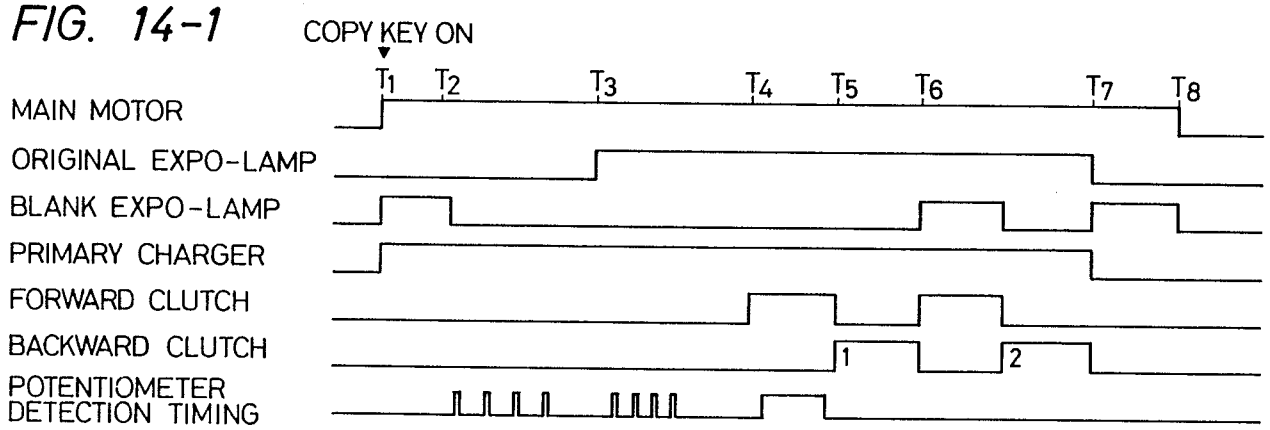
Figures 2, 14:
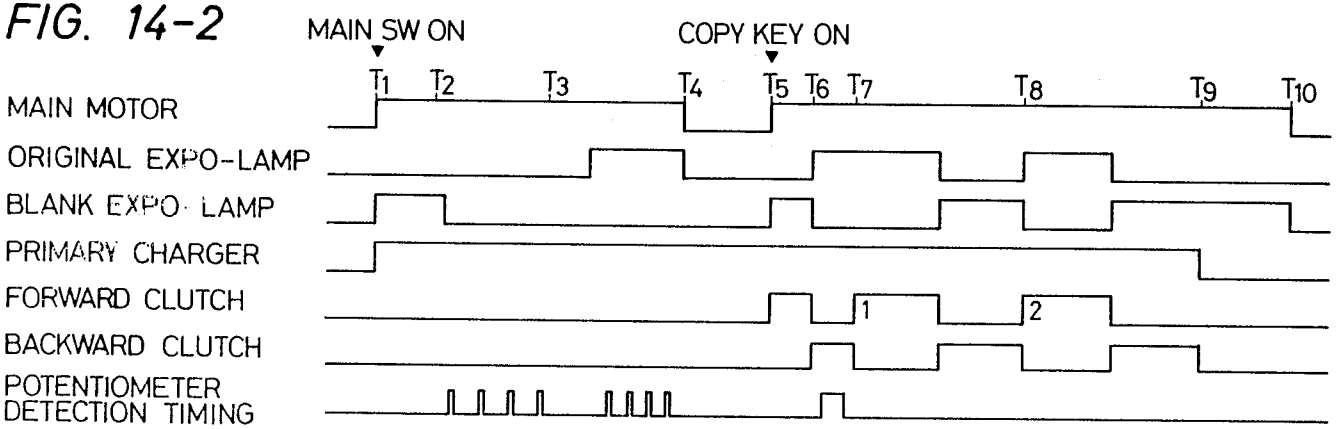

In an apparatus in which the original scanning is carried out during the backward motion of the optical system, it is possible to effect said preliminary scanning during the forward motion of the optical system and to effect the usual scanning during the backward motion. FIG. 14-1 is a timing chart showing the function in such case after the copy key is actuated for making two copies in the automatic exposure mode. The forward and backward motion of the optical system is realized respectively by energization of a forward clutch and a backward clutch.

Upon actuation of the copy key 53 at a time T1, the blank exposure lamp 2, pre-charger 7, primary charger 3 etc. are activated and the pre-rotation step is started to electrostatically cleaning the surface of the photosensitive drum 1. Thereafter the first control rotation is started from a time T2, in which the blank exposure lamp 2 is extinguished and the dark potential $V_D$ formed on the photosensitive drum is measured by the potential sensor 12 to control the reference current for the primary charger 3. In the present embodiment there are conducted four measurements and four controls, but it is also possible to vary the number of such controls according to the unmanipulated time of the apparatus.

Subsequently, at a time T3 the second control rotation is initiated, in which the illuminating lamp 23 is lighted in combination with the reference current controlled in the aforementioned first control rotation, thereby illuminating the photosensitive drum 1 with the light reflected by the standard white plate 39. The illumination intensity of said illuminating lamp 23 is controlled by the measurement of the surface potential $V_L$ in this state. The number of controls for the illuminating intensity of said lamp may also be rendered variable according to the unmanipulated time of the apparatus. In the present embodiment said control procedure consists of three measurements and three controls. The finally controlled light of said lamp 23 is again reflected by the standard white plate 39 and the corresponding surface potential of the drum is measured. The developing bias is determined in response to said surface potential, as explained before, in case the automatic exposure mode is not selected.

Then the forward clutch is energized at a time T4 to initiate the forward motion of the optical system, thereby effecting the preliminary scanning of the original document and forming a corresponding electrostatic latent image on the photosensitive drum. The potential of said latent image is measured by the potential sensor 12 and the developing bias is determined from the mean value of said potential.

Then at a time T5, the backward clutch is energized to initiate the backward motion of the optical system, thereby effecting the ordinary original scanning and forming an electrostatic latent image on the photosensitive drum 1. Said latent image is developed with the developing bias determined in the aforementioned manner, and the obtained image is transferred onto a first transfer sheet.

Subsequently, at a time T6, the optical system starts the second scanning motion to effect the ordinary scanning of the original document in the backward motion of said optical system, thereby achieving the image formation in the aforementioned manner.

At a time T7, the post-rotation step is started to electrostatically cleaning the photosensitive drum, which is stopped thereafter.

In an apparatus in which the ordinary original scanning is carried out during the forward motion of the optical system, the preliminary scanning can be carried out in an area corresponding to the minimum copiable original size, prior to the first scanning for image formation.

In the foregoing embodiment, the potential control for each zone is carried out after the actuation of the copy key, but it is also possible to effect such potential control after the start of power supply. FIG. 14-2 is a timing chart showing the function in such case, in which the original scanning is carried out during the forward motion of the optical system. FIG. 14-2 shows a case of making two copies in the automatic exposure mode. In this case, the preliminary scanning for detecting the background density of the original document is effected prior to the ordinary original scanning. Such preliminary scanning need not be effected over the entire area of the original document but may be effected over a distance equal to a half of the ordinary scanning distance, or over an area corresponding to the minimum copiable original size. In the present embodiment the preliminary scanning is effected in an area of B5 size.

After the start of. power supply, controls same as those at T1 to T4 in FIG. 14-1 are conducted at timings T1 to T4. Upon actuation of the copy key at a timing T5, the forward clutch is energized to start the forward motion of the optical system, thereby initiating the preliminary scanning. After such scanning motion over a distance corresponding to the B5 size, the illuminating lamp 11 and the backward clutch are turned on at a timing T6 to reverse the optical system thereby forming an electrostatic latent image corresponding to the original image on the photosensitive drum 1. The potential sensor 12 measures the potential of said latent image, and the mean value of said potential is obtained. In the automatic exposure mode, the developing bias is determined in the aforementioned manner.

The original scanning is repeated twice in the forward motion of the optical system at timings T7 to T9, thereby providing two copies. Subsequently the post-rotation step is conducted in the same manner as in the case of FIG. 14-1.

The above-described timing controls are achieved by counting the clock pulses supplied by the clock pulse generator 31 to the control unit 14.

Also in the automatic exposure mode, it is possible to employ the minimum value or integrated value of the potential instead of the mean value thereof. Furthermore it is possible to detect the light reflected from the original document with a photosensor.

Although the potentials $V_D$ and $V_L$ are independently controlled in the foregoing embodiment, these two potentials may also be defined as a function of the potential $V_D$, for example $V_L=(V_D-300V)\pm 15V$. Such method is advantageous as it is capable of controlling the contrast $V_D-V_L$ within a determined range even when the potential $V_D$ cannot be sufficiently stabilized. In such case the developing bias voltage can also be defined for example by $V_B=(V_L+50V)\pm 15$ V, and it is thus rendered possible to mutually correlate the contrast and the development level.

As explained in the foregoing, the present invention, employing different control zones according to the image magnification and the process speed, enables constant image formation with stable image density and stable intermediate tones regardless of the image magnification or the process speed.

Also the waste in control time can be avoided since the correction of the charging current and of the lighting voltage of the illuminating lamp is terminated after the repetition of predetermined times.

Furthermore, the correction of image forming conditions in response to the condition of the original after the control of the image forming conditions in each control zone allows optimum image formation for various original documents.

What is claimed is:

1. An image forming apparatus comprising:

image forming means for forming an image on a recording member with any one of a plurality of different image magnifications; and controls means for controlling the image forming conditions of said image forming means, wherein said control means control the image forming conditions in any one of a plurality of different control modes of which each has different parameter in accordance with the image magnification such that when the image magnification is anywhere within a first range the image forming conditions are controlled in a first control mode having a first parameter, and when the desired image magnification is anywhere within a second range the image forming conditions are controlled in a second control means having a second parameter.

2. An image forming apparatus according to claim 1, wherein said parameters are control data for controlling said image forming condition to be a predetermined condition and said control data are common in said respective control modes.

3. An image forming apparatus according to claim 2, wherein said control data are initial values for driving said image forming means for the control of the image forming conditions.

4. An image forming apparatus according to claim 2, wherein said control data are refreshed upon each selection of an image magnification within the first or second, respectively.

5. An image forming apparatus according to claim 4, wherein said control means comprises a memory for storing said control data.

6. An image forming apparatus according to claim 2 or 3, wherein said control means comprises a memory for storing said control data.

7. An image forming apparatus according to claim 1, wherein target values for control of the image forming conditions are constant regardless of the image magnification.

8. An image forming apparatus according to claim 1, wherein said image forming means comprises a charger for charging the recording member and an exposure lamp for illuminating the recording member and said control means is adapted to control at least one of said charger and said exposure lamp.

9. An image forming apparatus according to claim 8, wherein said control means comprises detecting means comprises detecting means for detecting the surface state of the recording member and is adapted to control at least one of said charger and said exposure lamp in response to the output of said detecting means.

10. An image forming apparatus according to claim 9, wherein said control means is adapted to detect said surface state a plurality of times and to control said charger or said exposure lamp, respectively, plural times.

11. An image forming apparatus according to claim 10, wherein said detecting means is adapted to detect the surface state of a dark area formed on said recording member and to control said charger in response to the output of said detection.

12. An image forming apparatus according to claim 10, wherein said detecting means is adapted to detect the surface state of a light area formed on said recording member and to control said exposure lamp in response to the output of said detection.

13. An image forming apparatus according to claim 10, wherein said surface state is surface potential.

14. An image forming apparatus according to claim 9, wherein said detecting means is adapted to detect the surface state of a dark area formed on the recording member and to control said charger in response to the output of said detection.

15. An image forming apparatus according to claim 14, wherein said surface state is surface potential.

16. An image forming apparatus according to claim 9, wherein said detecting means is adapted to detect the surface state of a light area formed on the recording member and to control said exposure lamp in response to the output of detection.

17. An image forming apparatus according to claim 16, wherein said surface state is surface potential.

18. An image forming apparatus according to claim 9, wherein said surface state is surface potential.

19. An image forming apparatus according to claim 1, wherein said control means is adapted to effect different control modes in response to the process speed of said image forming means.

20. An image forming apparatus according to claim 19, wherein said process speed is varied according to the feeding means of recording material.

21. An image forming apparatus according to claim 19, wherein said process speed is varied according to the thickness of recording material.

22. An image forming apparatus comprising:

image forming means for forming an image on a recording material at any one of a plurality of different process speeds;

selecting means for selecting one from among said different process speeds;

control means for controlling the image forming conditions of said image forming means in accordance with the process speed; and memory means for storing a plurality of control data obtained through the control of said image forming conditions by said control means for respective ones of said process speeds, wherein said control means selects determined control data from said plurality of control data stored in said memory means in accordance with the process speed selected by said selecting means, controls said image forming control data newly obtained after completion of said control of the image forming conditions to be stored in said memory means for subsequent selection by said control means.

23. An image forming apparatus according to claim 22, wherein said control data are initial values, associated with said control of the image forming conditions, for driving said image forming means.

24. An image forming apparatus according to claim 22 or 23, wherein said control means comprises a memory for storing said control data.

25. An image forming apparatus according to claim 22, wherein target values of said control of the image forming conditions are constant regardless of said process speed.

26. An image forming apparatus according to claim 22, wherein said process speed is varied according to a feeding means of recording material.

27. An image forming apparatus according to claim 26, wherein a low process speed is selected when the recording material is manually fed.

28. An image forming apparatus according to claim 22, wherein said process speed is varied according to the thickness of the recording material.

29. An image forming apparatus according to claim 28, wherein a low process speed is selected when the recording material has a large thickness.

30. An image forming apparatus comprising:

image forming means for forming on a recording member with any one of a plurality with any one of a plurality of different image magnifications;

selecting means for selecting one among said different image magnifications;

control means for controlling the image forming condition of said image forming means in accordance with the image magnification; and memory means for storing a plurality of control data obtained through the control of said image forming condition by said control means for respective ones of said image magnifications, wherein said control means selects determined control data from said plurality of control data stored in said memory means in accordance with the image magnification selected by said means, controls said image forming condition based on the selection control data, and causes control data newly obtained after completion of said control of the image forming conditions to be stored in said memory means for subsequent selection by said control means.

31. An image forming apparatus comprising:

image forming means for forming an image on a recording member with any one of a plurality of different image magnifications;

control means for controlling the image forming conditions of said image forming means in accordance with the image magnification; and memory means for storing a plurality of control data obtained from control of said image forming conditions by said control means, wherein said control means selects determined control data from said plurality of control data stored in said memory means in accordance with the image magnification, and controls said image forming conditions based on the selected control data and wherein said control means is adapted to the control the image forming conditions of said image forming means such that when the desired image magnification is anywhere within one of several predetermined ranges and the desired process speed is a predetermined value, said image forming means is controlled in a control mode common throughout that predetermined range.

32. An image forming apparatus according to claim 31, wherein control data for image formation are maintained constant in the respective control mode corresponding to a particular predetermined range.

33. An image forming apparatus according to claim 32, wherein said control data are initial values for driving said image forming means for control of the image forming conditions.

34. An image forming apparatus according to claim 1, wherein said control means is adapted to detect the image density of an original after controlling the image forming conditions in the desired control mode, and is adapted to further control the image forming conditions in accordance with the detected image density.

35. An image forming apparatus according to claim 30 wherein said control means controls said image forming conditions in accordance with a plurality of parameters including the image magnification.

36. A image forming apparatus according to claim 35, wherein the parameters include process speed, and said image forming means is capable of forming an image on the recording member at different process speeds.

* * * * *

UNITED STATES PATENT AND TRADEMARK OFFICE

CERTIFICATE OF CORRECTION

PATENT NO. : 4,872,035

DATED : October 3, 1989

INVENTOR(S) : HIROYUKI MIYAKE, ET AL.

It is certified that error appears in the above-identified patent and that said Letters Patent is hereby corrected as shown below:

COLUMN 1

Line 27, "2B" should read --1B--.

COLUMN 2

Line 7, "position" should read --position close to the secondary charger 502, which eliminates--.
Lines 40-46, lines 40 to 46 should be deleted.

COLUMN 5

Line 16, "the," should read --the--.

COLUMN 6

Line 16, "photo interrupter" should read --photointerrupter--.
Line 36, "he" should read --the--.
Line 62, "control" should read --controls--.

COLUMN 7

Line 21, "on" should read --of--.

UNITED STATES PATENT AND TRADEMARK OFFICE

CERTIFICATE OF CORRECTION

PATENT NO. : 4,872,035

DATED : October 3, 1989

INVENTOR(S) : HIROYUKI MIYAKE, ET AL.

It is certified that error appears in the above-identified patent and that said Letters Patent is hereby corrected as shown below:

COLUMN 9

Line 25, "sheet" should read --sheets--.
Line 32, "sheet" should read --sheets,--.
Line 37, "sheets" should read --sheet--.

COLUMN 10

Line 18, "supply $\alpha$: correction" should read --supply ¶ $\alpha$: correction--.
Line 21, "potential" should read --potential:--.
Line 32, "$V_L$ target" should read --$V_L$: target--.
Line 58, "$\Delta V_{H \cdot AE}$ amount" should read --$\Delta V_{H \cdot AE}$: amount--.

COLUMN 11

Line 7, "manner" should read --manner.--.
Line 38, "light potential V" should read --light potential $V_L$--.
Line 61, "upper limit $I_p$ limit" should read --upper limit $I_{plimit}$--.

COLUMN 12

Line 42, "amount of correction $V_{H \cdot AE}$" should read --amount of correction $\Delta V_{H \cdot AE}$--.

UNITED STATES PATENT AND TRADEMARK OFFICE

CERTIFICATE OF CORRECTION

PATENT NO. : 4,872,035

DATED : October 3, 1989

INVENTOR(S) : HIROYUKI MIYAKE, ET AL.

It is certified that error appears in the above-identified patent and that said Letters Patent is hereby corrected as shown below:

COLUMN 13

Line 15, "cleaning" should read --clean--.
Line 67, "cleaning" should read --clean--.

COLUMN 15

Line 15, "controls means" should read --control means--.
Line 17, "control" should read --controls--.
Line 19, "different" should read --a different--.
Line 26, "second control means" should read --second control mode--.
Line 40, "ond, respectively." should read --ond range, respectively.--.
Line 55, "member" should read --member,--.
Line 60, "comprises detecting means" should be deleted.

COLUMN 16

Line 24, "of detection." should read --of said detection.--.
Line 57, "forming control" should read --forming conditions based on the selected control data, and causes control--.

UNITED STATES PATENT AND TRADEMARK OFFICE

CERTIFICATE OF CORRECTION

PATENT NO. : 4,872,035

DATED : October 3, 1989

INVENTOR(S) : HIROYUKI MIYAKE, ET AL.

It is certified that error appears in the above-identified patent and that said Letters Patent is hereby corrected as shown below:

COLUMN 17

Line 20, "forming on" should read --forming an image on--.
Line 21, "with any one of" should be deleted.
Line 22, "a plurality" should be deleted.
Line 37, "said means," should read --said selecting means,--.

COLUMN 18

Line 15, "the" should be deleted.
Line 38, "30" should read --30,--.
Line 41, "A" should read --An--.

Signed and Sealed this

Thirty-first Day of March, 1992

*Attest:*

*Attesting Officer*

HARRY F. MANBECK, JR.

*Commissioner of Patents and Trademarks*